US009022500B2

(12) United States Patent
Leighton et al.

(10) Patent No.: US 9,022,500 B2
(45) Date of Patent: May 5, 2015

(54) SYSTEM AND METHOD FOR ADJUSTING THE REGISTRATION OF AN IMAGE APPLIED TO RECORDING MEDIA IN A PRINTING SYSTEM

(75) Inventors: Roger G. Leighton, Hilton, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 223 days.

(21) Appl. No.: 13/586,256

(22) Filed: Aug. 15, 2012

(65) Prior Publication Data

US 2014/0049575 A1 Feb. 20, 2014

(51) Int. Cl.

| | |
|---|---|
| ***B41J 29/38*** | (2006.01) |
| ***B41J 3/60*** | (2006.01) |
| ***B41J 15/04*** | (2006.01) |

(52) U.S. Cl.

CPC .. *B41J 3/60* (2013.01); *B41J 29/38* (2013.01); *B41J 15/04* (2013.01)

(58) Field of Classification Search

CPC .. B41J 2/0458; B41J 2/04563; B41J 2/04591; B41J 2/04581; B41J 29/393

See application file for complete search history.

(56) References Cited

U.S. PATENT DOCUMENTS

| | | | | |
|---|---|---|---|---|
| 6,374,076 | B1 * | 4/2002 | Tanaka | 399/396 |
| 7,665,817 | B2 | 2/2010 | Folkins | |
| 7,878,617 | B2 | 2/2011 | Mizes et al. | |
| 2008/0124158 | A1 * | 5/2008 | Folkins | 399/396 |
| 2011/0061552 | A1 | 3/2011 | Eun et al. | |
| 2011/0063357 | A1 * | 3/2011 | Eun et al. | 347/17 |
| 2011/0273502 | A1 * | 11/2011 | Eun et al. | 347/14 |
| 2012/0062641 | A1 * | 3/2012 | Dejong et al. | 347/19 |

* cited by examiner

*Primary Examiner* — Manish S Shah
*Assistant Examiner* — Jeremy Delozier
(74) *Attorney, Agent, or Firm* — Maginot Moore & Beck LLP

(57) ABSTRACT

A system and method for adjusting the registration of an image applied to recording media in a printer. The timing of the ejection of ink from an inkjet printhead of the printer is adjusted to maintain proper registration of a first side image to a second side image for duplex printing and y registration within a second side image printing from a first color print unit, such as magenta, to a last print unit, such as black. The location of a leading edge of the first side image deposited on a continuous web of recording media is identified and the timing of ink ejection from printhead nozzles is adjusted to align the second side image to the first side image. Adjustment of the timing of ink ejection reduces or eliminates observable registration errors.

7 Claims, 4 Drawing Sheets

SYSTEM AND METHOD FOR ADJUSTING THE REGISTRATION OF AN IMAGE APPLIED TO RECORDING MEDIA IN A PRINTING SYSTEM

TECHNICAL FIELD

This disclosure relates generally to a printing system and methods for adjusting the registration of a duplex image applied to a continuous web of recording media in a printing system, and more particularly systems and methods for adjusting the registration of a duplex image in response to the presence and thickness of ink on at least one side of the duplex image formed on the continuous web of recording media.

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets solidify. The printhead unit ejects ink from a plurality of inkjet nozzles, also known as ejectors.

The media used in both direct and offset printers can be in web form. In a web printer, a continuous supply of media, typically provided in a media roller, is entrained onto rollers that are driven by motors. The motors and rollers pull the web from the supply roller through the printer to a take-up roller. The rollers are arranged along a linear media path, and the media web moves through the printer along the media path. As the media web passes through a print zone opposite the printhead or heads of the printer, the printheads eject ink onto the web. Along the feed path, tension bars or other rollers remove slack from the web so the web remains taut without breaking.

Existing web printing systems use a registration control method to control the timing of the ink ejections onto the web as the web passes the printheads. One known registration control method that can be used to operate the printheads is the single reflex method. In the single reflex method, the rotation of a single roller at or near a printhead is monitored by an encoder. The encoder can be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller can adjust the linear web velocity calculation by using tension measurement signals generated by one or more load cells that measure the tension on the web near the roller. The controller implementing the single reflex method is configured with input/output circuitry, memory, programmed instructions, and other electronic components to calculate the linear web velocity and to generate the firing signals for the printheads in the marking stations.

Another existing registration control method that can be used to operate the printheads in a web printing system is the double reflex method. In the double reflex method, each encoder in a pair of encoders monitors one of two different rollers. One roller is positioned on the media path prior to the web reaching the printheads and the other roller is positioned on the media path after the media web passes the color printheads. The angular velocity signals generated by the two encoders for the two rollers are processed by a controller executing programmed instructions for implementing the double reflex method to calculate the linear velocity of the web at each roller and then to interpolate the linear velocity of the web at each of the printheads. These additional calculations enable better timing of the firing signals for the printheads in the marking stations and, consequently, improved registration of the images printed by the marking stations in the printing system. Ejection of ink from the inkjet nozzles can be adjusted based on the calculations. A double reflex printing system is disclosed in issued U.S. Pat. No. 7,665,817.

While control of the rotational speed of rollers is critical to the proper registration of images, other factors besides web transport can affect image registration. For instance, the material properties of the recording media can affect registration. If the continuous web slips when engaged with one or more rollers in the media path, the position of the media web with respect to the printheads is affected and errors in images formed on the media web can occur. In addition, if the web either stretches or shrinks during imaging, misregistration of images can occur. Likewise, the amount of ink deposited on the continuous web can affect the material properties of the web and result in misregistration of images as well. Consequently, improvements to a printing system and to printing images by taking into account the type of media, the amount of ink being deposited on the continuous web, and environmental conditions at the printer are desirable.

SUMMARY

A method of adjusting operation of a printing system by taking into account the presence and thickness of an image on a recording media has been developed. A method of adjusting the registration of a first side image and a second side image deposited on a continuous web of recording media moving along a web path from a first roller to a second roller of a printer having an inkjet printhead is described. The method includes determining a first velocity of the first roller, determining a change in the first velocity and the time of the occurrence of the change in the first velocity, determining a second velocity of the second roller, and adjusting the timing of ejection of ink from the printhead to register the first side image to the second side image based on the change in the first velocity, the time of the occurrence of the change in the first velocity, and the second velocity.

A printing system is configured to adjust the velocity of a continuous web of recording media in response to the presence and thickness of a duplex image at an apex roller of the printing system. The printing system prints a duplex image having a first side image and a second side image on a continuous web of recording media moving in a downstream direction along a web path from a first roller to a second roller. The printing system includes a printhead disposed adjacent to the continuous web of recording media wherein the printhead includes a plurality of nozzles configured to eject ink on the recording media. A first velocity sensor is configured to generate a first velocity signal representative of the velocity of the web at the first roller and a second velocity signal representative of a change in velocity of the web at the first roller. A second velocity sensor is configured to generate a second velocity signal representative of the velocity of the web at the second roller. A controller is operatively connected to the printhead, to the first velocity sensor and to the second velocity sensor. The controller is configured to generate a time stamp signal representative of the time of the change in the first velocity signal and to adjust the timing of the ejection of ink based upon the change in the first velocity signal, the second velocity signal, and the time stamp signal.

A method of adjusting the timing of the ejection of ink in a double reflex printing system provides a duplex image having a first side image and a second side image. The first side image and second side image are deposited on opposite sides of a continuous web of recording media moving along a web path from a first roller to a second roller. The first side image and the second are substantially aligned to provide proper registration of images. The method of adjusting includes determining a first radius of the first roller, determining a second radius of the second roller, determining a first arrival time of the recording media contacting the first roller, determining a wrap angle of the recording media contacting the second roller, determining a change in velocity experienced by the first roller coming into contact with the first side image, and determining a velocity offset with reference to the first radius, the first arrival time, the second radius, the wrap angle, and the change in velocity of the first roller.

DETAILED DESCRIPTION

Figure 1:
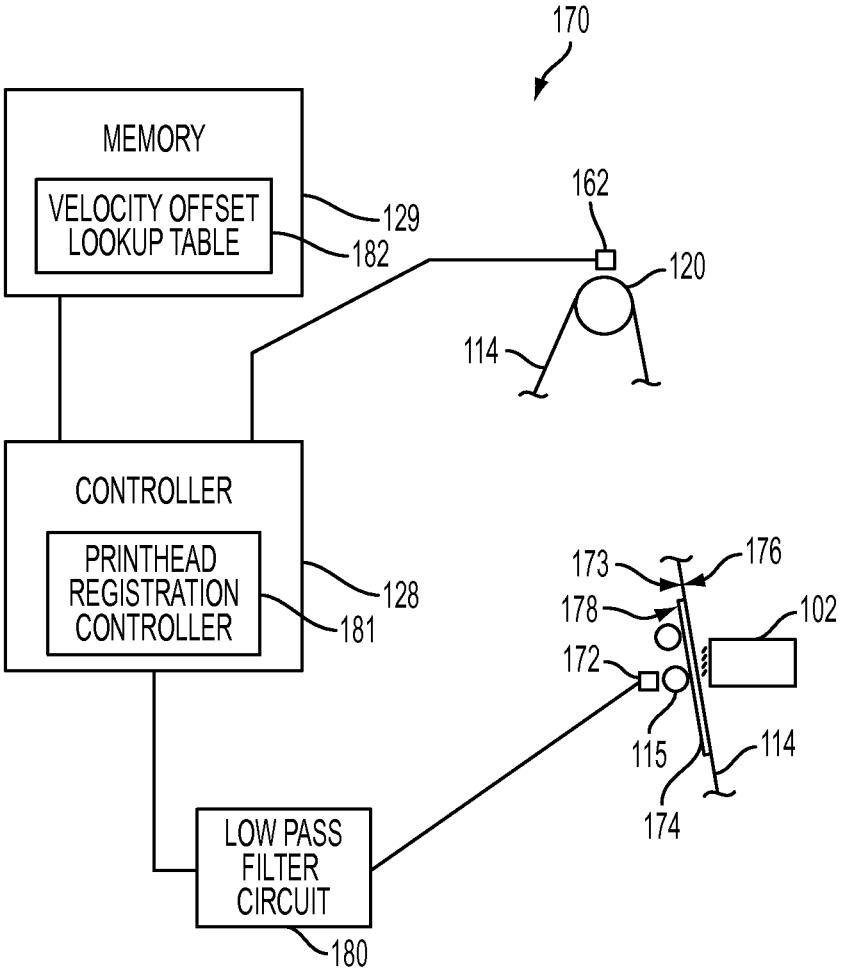
FIG. 1 is block diagram of one embodiment of a portion of a printing system having a velocity offset system for adjusting the registration of images being printed on a continuous web of print media.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web moves through a printer during the printing process. Examples of media webs include rollers of paper or polymeric materials used in printing. The media web has two sides having surfaces that can each receive images during printing. Each surface of the media web is made up of a grid-like pattern of potential drop locations, sometimes referred to as pixels.

As used herein, the term "capstan roller" refers to a cylindrical member configured to have continuous contact with the media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member.

Figure 4:
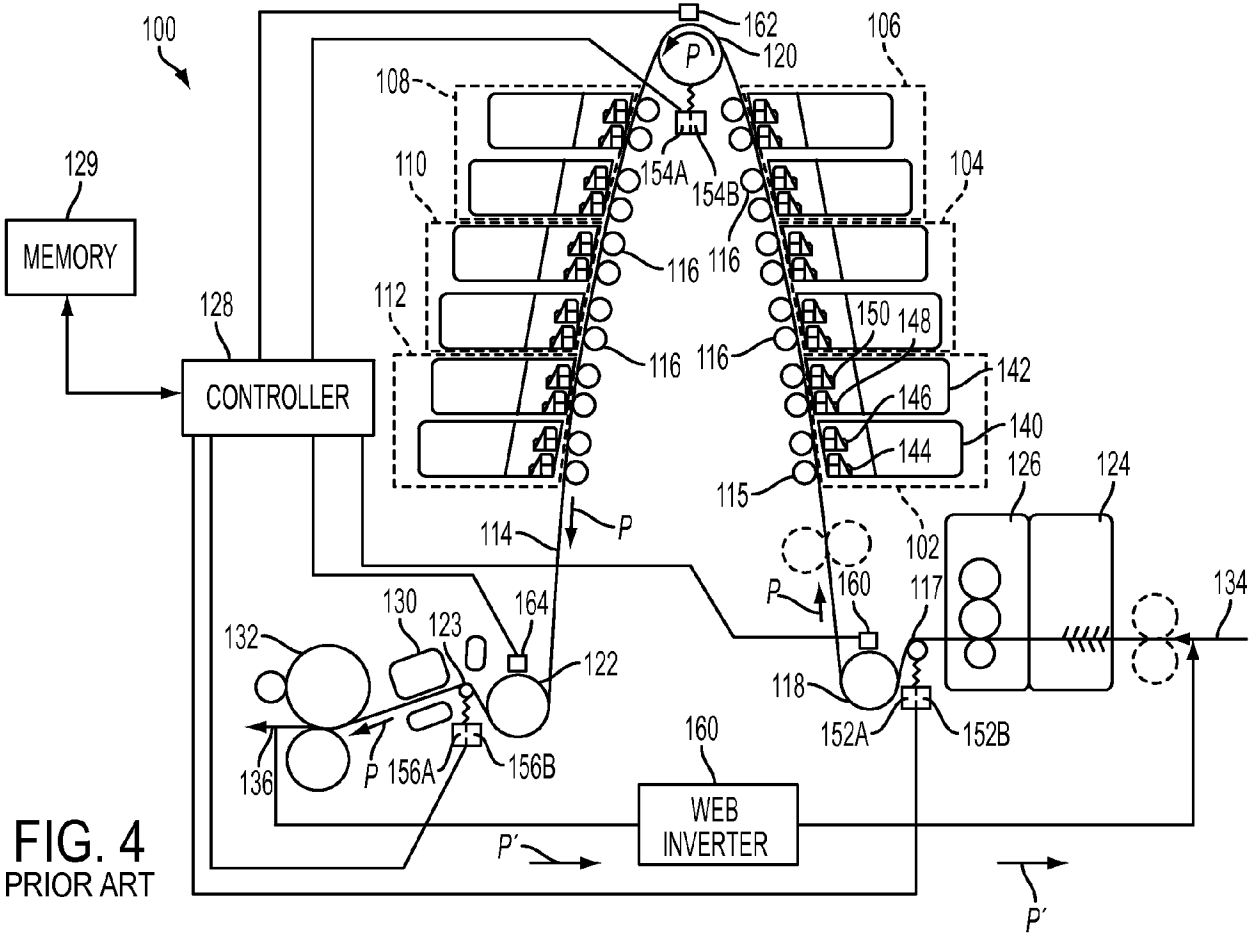
FIG. 4 PRIOR ART
FIG. 4 is a schematic diagram of a prior art duplex continuous web printing system.

FIG. 4 depicts a prior art inkjet printer 100 having elements pertinent to the present disclosure. In the embodiment shown, the printer 100 implements a solid ink print process for printing onto a continuous media web. Although the image registration control method and system are described below with reference to the printer 100 depicted in FIG. 4, the subject method and apparatus disclosed herein can be used in any printer, such as a cartridge inkjet printer, which uses serially arranged printheads to eject ink onto a web image substrate.

FIG. 4 depicts a continuous web printer system 100 that includes six print modules 102, 104, 106, 108, 110, and 112; a controller 128, a memory 129, guide roller 115, guide rollers 116, pre-heater roller 118, apex roller 120, leveler roller 122, tension sensors 152A-152B, 154A-154B, and 156A-156B; and velocity sensors, such as encoders 160, 162, and 164. The print modules 102, 104, 106, 108, 110, and 112 are positioned sequentially along a media path P and form a print zone for forming images on a print medium 114 as the print medium 114 travels past the print modules. Each print module 102, 104, 106, 108, 110, and 112 in this embodiment provides an ink of a different color. In all other respects, the print modules 102, 104, 106, 108, 110, and 112 are substantially identical. The media web travels through the media path P guided by rollers 115 and 116, pre-heater roller 118, apex roller 120, and leveler roller 122. In FIG. 4, the apex roller 120 is an "idler" roller, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader 132 are located at the opposite end 136 of the media path P.

A web inverter 160 is configured to direct the media web 114 from the end 136 of media path P to the beginning 134 of the media path through an inverter path P'. The web inverter 160 flips the media web and the inverter path P' returns the flipped web to the inlet 134 to enable duplex printing where the print modules 102-112 form one or more ink images on a second side (second side ink image) of the media web after forming one or more images on the first side (first side ink image). In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 102-112 is configured to eject ink drops onto both sections of the media web. Each of the rollers 115, 116, 118, 120, and 122 also engage both the first and second sections of the media web. After the second side of the media web 114 is imaged, the media web 114 passes the end of the media path 136. Registration of a second side ink image to a first side ink image forms a duplex image.

As illustrated in FIG. 4, print module 102 includes two print submodules 140 and 142. Print submodule 140 includes two print units 144 and 146. The print units 144 and 146 each include an array of printheads that are arranged in a staggered configuration across the width of both the first section of web media and second section of web media. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path P at a predetermined resolution. In the example of FIG. 4, print submodule 140 is configured to emit ink drops in a twenty inch wide path that includes both the first and second sections of the media web at a resolution of 300 dots per inch. Ink ejectors in each printhead in print units 144 and 146 are configured to eject ink drops onto predetermined locations of both the first and second sections of media web 114. Print module 102 also includes submodule 142 that has the same configuration as submodule 140, but has a cross-process alignment that differs from submodule 140 by one-half of a pixel. This enables printing system 100 to print with twice the resolution as provided by a single print submodule. In the example of FIG. 4, submodules 140 and 142 enable the printing system 100 to emit ink drops with a resolution of 600 dots per inch. Each of other print modules 104-112 can be similarly configured for duplex printing.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 102, 104, 106, 108, 110, and 112. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also hold one or more values that identify tension levels for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rollers 120, 118, and 122. Typical embodiments of encoders 160, 162, and 164 include Hall effect sensors configured to generate signals in response to the movement of magnets operatively connected to the rollers and optical wheel encoders that generate signals in response to a periodic interruption to a light beam as a corresponding roller rotates. Controller 128 is operatively connected to the encoders 160, 162, and 164 to receive the angular velocity signals. Controller 128 can include hardware circuits, software routines, or both, configured to identify a linear velocity of each of the rollers 120, 118, and 122 using the generated signals and a known radius for each roller.

Tension sensors 152A-152B, 154A-154B, and 156A-156B are operatively connected to a guide roller 117, apex roller 120, and post-leveler roller 123, respectively. The guide roller 117 is positioned on the media path P prior to the preheater roller 118. The post-leveler roller 123 is positioned on the media path P after the leveler roller 122. Each tension sensor generates a signal corresponding to the tension force applied to the media web at the position of the corresponding roller. Each tension sensor can be a load cell configured to generate a signal that corresponds to the mechanical tension force between the media web 114 and the corresponding roller.

In FIG. 4 where two sections of the media web 114 engage each roller in tandem, each of the tension sensors are paired to identify the tension on each section of the media web 114. In embodiments where one surface of the media web engages each roller, a single tension sensor can be used instead. Tension sensors 152A-152B generate signals corresponding to the tension on the media web 114 as the media web 114 enters the print zone passing print modules 102-112. Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

Referring now to FIG. 1, the prior art printer system 100 is modified to include a velocity offset system 170 for adjusting the registration of images being printed on the continuous web of print media 114. The system 170 includes a velocity sensor, such as an encoder 172, disposed adjacently to the roller 115, also known as a "backer bar roller." The encoder 172 includes a similar configuration as the encoders 160, 162, and 164 described above. The encoder 172 generates an angular velocity signal of the roller 115 and can include a Hall effect sensor configured to generate a signal representative of the angular velocity of the roller 115. An optical wheel encoder that generates signals in response to a periodic interruption to a light beam can also be used. The encoder 172 generates a signal representative of an angular velocity of the roller 115.

During printing of duplex images, a first side 173 of the continuous web of recording media 114 receives a layer of ink 174. The layer of ink 174 corresponds to a first side image of a duplex image. After printing, the first side 173 of the continuous web receiving ink is reversed such that a second side 176 of the continuous web not having ink is moved toward and past the print modules 102, 104, 106, 108, 110, and 112 for imaging, one of which is illustrated in FIG. 1. As the continuous web 114 moves past the module 102, a leading edge 178 of the layer of ink 174 contacts the roller 115 which experiences an identifiable step change in the rotational velocity being measured by the encoder 172. This step change not only affects the rotational velocity of the roller 115, but can also affect the rotational velocity of the apex roller 120 since the effective mean radius at the apex roller 120 can increase by the thickness of the deposited ink. Even though the thickness of the ink increases the effective mean radius of the apex roller 120 by a small amount, approximately 0.033%, the angular velocity of the apex roller 120 can be reduced sufficiently to provide a registration error of up to 400 micrometers (um). The change in velocity results from an increase in radius from the center of the roller to the imaging surface. The change in angular velocity can be significant enough to introduce image defects into the printed images when taken alone or in combination with other image defects resulting from roller eccentricities, temperature, humidity, web velocity and web tension irregularities.

By placing an encoder at the backer bar roller 115, a velocity signal can be generated sufficiently early enough along the web path to adjust the angular velocity of the roller 120, if appropriate. In one embodiment, the distance which the print module 102 to the print module 112 can be up to and including two meters. Greater distances can also be provided in a printer. By locating the encoder 172 at the roller 115 in this embodiment, a sufficient amount of time can be provided to develop a signal representative of a change in velocity at the roller 115 which can be used to determine a change in velocity at the apex roller 120 before the layer of ink 174 arrives at the apex roller 120. The change in velocity can be used to adjust the registration of a first side image to a second side image.

To provide a signal indicating a change in velocity at the roller 115, a low pass filter circuit 180 is operatively connected to the encoder 172. The low pass filter circuit 180 filters out higher frequency components resulting from printer components, including roller eccentricities, drive motor stiffness, and gear box meshing. In one embodiment, the change in velocity can be determined with a Butterworth filter, including a $2^{nd}$ order Butterworth filter having a cutoff at 1 hertz or a $4^{th}$ order Butterworth filter having a cutoff at 0.1 to 1 hertz. An output of the low pass filter circuit 180 is operatively connected to the controller 128.

In one embodiment, a reduction in speed at the apex roller 120 can be approximately 0.033% of 2 meters/second or approximately 0.7 millimeters/second. The reduction in speed at the backer bar roller 115 is approximately 0.05% or 1 mm/sec. The average velocity variation on the apex 120 roll is approximately 0.3% to 0.35% and the average velocity at the roller 115, which is nearest the preheater roller 118 is 0.2 to 0.25%. Consequently, by using a $2^{nd}$ order Butterworth filter from 0.1 to 1 hertz to detect a change in speed at the backer bar roller 115 provides a sufficient notification of a velocity change to compensate for a later velocity change at the apex roller 120. Therefore, the accuracy of a measurement of velocity change at the roller 115 is approximately 5:1 verses 10:1 at the apex roller 120. In one embodiment, the backer bar roller 115 has a smaller diameter than the diameter of the apex roller 120, wherein the backer bar roller 115 has a radius of about 29.2 mm and the apex roller 120 has a radius of about 38 mm.

The velocity at the roller 115 is used to determine the effect of the ink image on the velocity at the apex roller 120. The accuracy of the low pass filter is limited by the amount of time taken to accumulate sufficient data for the low pass filter circuit 180. A low pass filter of 1 hertz can take approximately 160 milliseconds for one time constant of 63%. With the encoder placed on the roller 115, there is approximately 0.535 seconds before the leading edge 178 reaches the apex roller 120. This amount of time can allow for three time constants or approximately 95% of the signal to accumulate at the low pass filter circuit 180.

In operation, controller 128 determines the tension of the media web 114 at the guide roller 117, the apex roller 120, and the post-leveler roller 123. The velocity of the web 114 is measured on the preheat drum 118, the backer bar roller 115, the apex roller 120, and the leveler drum 122. Using the values of the tensions and the velocities, the controller 128 can be configured to adjust one of or both of the tensions of the web and the velocity of the web. In one embodiment, a double reflex printing algorithm can be configured in the controller 128 to adjust the velocity of the rollers to account for a change in speed of the web resulting from material properties of the web as well as the amount of ink deposited on the web. The material properties of the web can be influenced by the media type, the humidity content of the web, and the temperature of the web, and the ambient or operating temperature of the printer.

The double reflex printing method, configured for operation in the controller 128, receives the encoder signals from the preheat drum 118, the apex roller 120, and the leveler drum 122. The controller 128 receives velocity signals from the rollers 118, 120, and 122. Tension signals representing the tension between the inlet 134 and the preheat roller 118 and between the preheat roller 118 and the leveler roller 122 are received by the controller 128.

The controller 128 is also configured to monitor any change in velocity of the web resulting from the leading edge 178 of the layer of ink 174 contacting the backer bar roller 115. The controller 128 determines the change in velocity measured at the backer bar roller 115 and the time at which the change occurs. Using this information as well as the velocity of the apex roller, the controller 128 can adjust the timing of the ejection of ink from the printhead nozzles using an image registration controller 181. While the image registration controller 181 can be configured as software resident in the controller 128, the image controller 181 can be a dedicated integrated circuit, such as an ASIC. The image controller 181 can also be embodied in the double reflex printing algorithm.

The image registration controller 181 adjusts the timing of the ejection of ink from the printhead nozzles to align the first side image to the second side image for proper registration in the duplex printing process through the use of a TOF (top of form mark). The y registration error generated by the introduction of 2 layers of ink on side 1 is roughly 400 um. This error can be both with respect to the paper edge as well as within the print units. By determining an effective change in velocity of the apex roller 120, misregistration of a first side ink image to a second side ink image can be reduced or eliminated. However, the y registration, occurring from the first print unit 114 to the last print unit in the printhead module 112, within a single image on side 2 can be improved dramatically to make the 2 sigma target of 30 um.

In one embodiment, the controller 128 can adjust the timing of the ejection of ink from the printhead nozzles using the change in velocity determined at the backer bar roller 115 and the time at which the change in velocity at the roller 115 occurs. The effective velocity of the apex roller 120 can then be determined by calculating a velocity offset value which can be stored in a lookup table 182 located in the memory 129. The lookup table is populated with a number of predetermined offset values which the controller 128 can manipulate to adjust the location of second side images to first side images for duplex printing.

Figure 2:
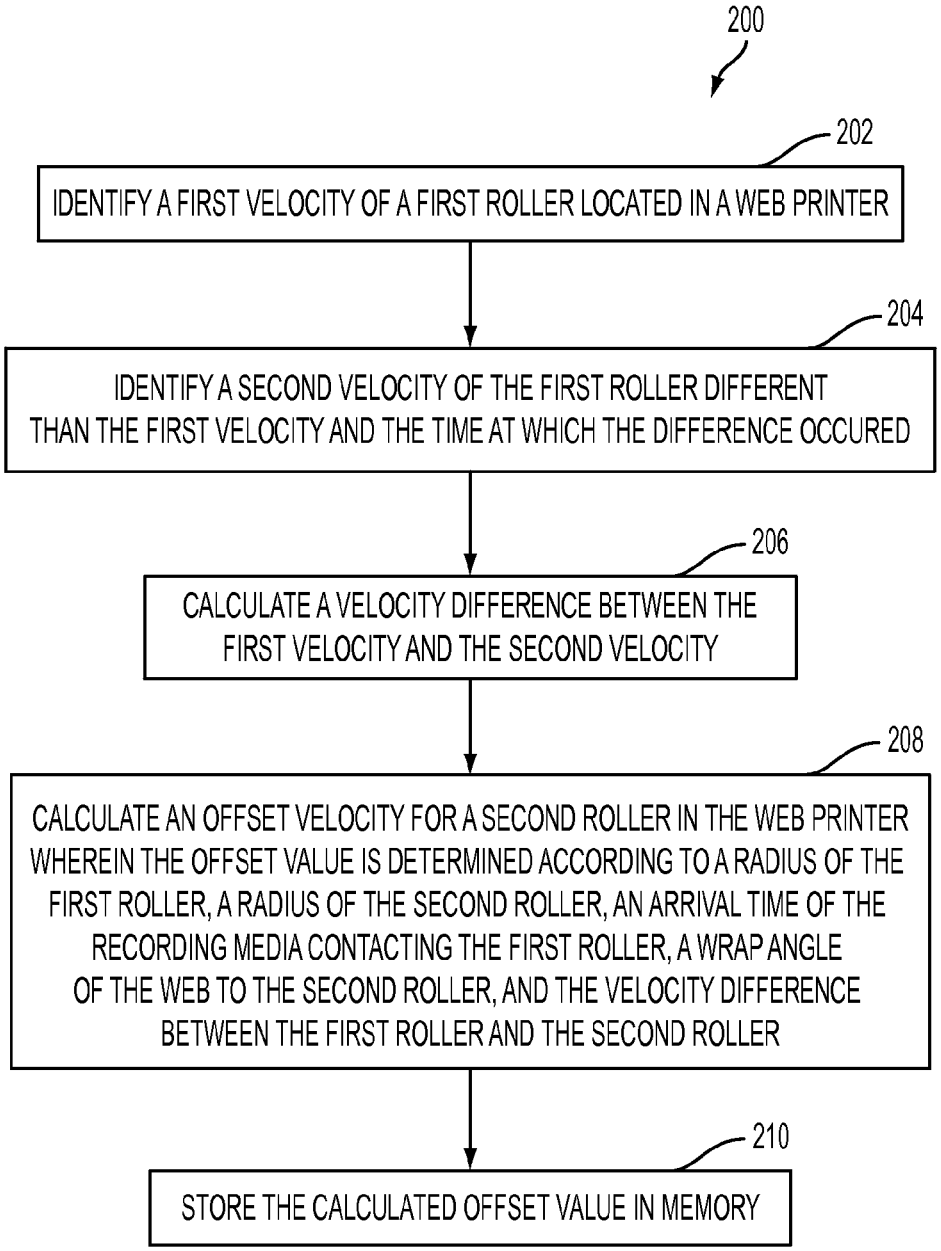
FIG. 2 is a flow diagram of a method for providing a plurality of velocity offsets to adjust the registration of images formed on a continuous web of print media in a printing system.

FIG. 2 illustrates a flow diagram 200 for determining a plurality of offset values which can be used by the controller 128 to control image registration for duplex printing. The plurality of offset values can be determined using a computer simulation. The error can be estimated for 1 layer (5 um) or 2 layers (10 um) of thickness. If no change occurs then the offset remains at zero. At the end of the step change (passing of the ink coverage) the offset error is set back to zero to avoid accumulation.

The plurality of offset values can be used by the controller 128 to determine a change in the speed of the recording media web resulting from ink being deposited on a first side of the web to form a duplex image. Since the ink adds thickness to the web and increases the distance of the printing surface of the web from the rotational centerline of the rollers, the velocity of the roller can change. To determine a first offset value, a first velocity of the web is determined by measuring the rotational velocity of the roller 115 as determined by the encoder 172 (block 202) and passing the signal through a $2^{nd}$ order Butterworth filter with low bandpass of 0.1 to 1 hertz to capture the abrupt velocity change. The identified velocity value can be stored in the memory 129, or another memory location accessible by the controller 128, and is compared on a continuing basis with the current velocity of the roller 115. When the velocity of the roller 115 changes because the leading edge 178 of the layer of ink 174 contacts the roller 115, a step change in velocity of the roller 115 is identified (block 204). The step change can be identified by the controller 128 which can be configured to include a comparator to compare the velocity signal to a predetermined value which indicates that a change has occurred. In one embodiment, a change in velocity of from 2.0202 meters/second to 2.0194 meters/second can be sufficient to indicate that the first side image 174 has contacted the roller 115. The step change can make the roller go slower. The velocity signal generated by the encoder 172 and filtered by the low pass filter circuit 180, which is the changed velocity, is identified (block 204). A second velocity, or velocity after the step change, is then compared to the first velocity to calculate a difference in velocity between the first velocity and the second velocity (block 206). The velocity difference between the first velocity and the second velocity is stored for use by the controller 128 in an accessible memory, which can include the memory 129. The filter allows the capture of the transition that is only 0.033%. Other values of transitions can also be captured.

Once the first velocity, the second velocity, and the velocity difference are known, an offset velocity for a second roller, such as the apex roller 120 is determined (block 208). The offset velocity is calculated to determine the amount of a change in velocity that can occur at the second roller due to the arrival of the ink image 174. The offset velocity can be determined as a function of a radius of the first roller, a radius of the second roller, an arrival time of the recording media contacting the backer bar roller, a wrap angle of the web to the second roller, and the velocity difference between the first roller and the second roller. Once the calculated offset value is determined, the value is stored in memory 129 in the lookup table 182 (block 210). The corrected threshold velocity is set at 50% of the max filtered velocity change.

$$V_{threshold} = .5 * V_{backer\ roll} * \left(\frac{t_{ink}}{R_{backer\ roll} + t_{paper} + t_{ink}}\right)$$

$V_{threshold}$ is used in a logic statement to enable the offset or to keep the gain equal to 1.0. The logic statement is used to determine whether to apply the velocity offset.

The computed velocity delta from the filtered output is determined as follows:

$$\Delta\text{velocity} = v_{nominal} - v_{slower}$$

Once the velocity delta is determined, the approximate ink layer thickness is determined as follows:

$$\Delta t_{ink} = \Delta vel * \left(\frac{R_{backer\ roll} + t_{paper}}{v_{slower}}\right)$$

Using the ink layer thickness, an offset factor, $F_{offset}$, can be computed to determine a compensation for the apex roller velocity change at t(sec) delay as follows:

$$F_{offset} = \left(1 + \frac{\Delta t_{ink}}{R_{backer\ roll} + t_{paper} + \Delta t_{ink}}\right)$$

Using these values, the apex compensated velocity correction is determined as follows:

$$V_{apexcorrected} = F_{offset} * V_{apexuncompensated}$$

The flow diagram 200 of FIG. 2 is repeated a plurality of times to generate a group of offset values, each group being stored in the lookup table 182. Each group of offset values can be determined according to certain characteristics of the printing system including the type of media, the type of ink, and the type of printer in which the media and ink are being utilized. For example, in one printer the distance from the roller 115 to the apex roller 120 can be approximately 1.5 meters, the media type can be paper with a predetermined thickness, the ink can be phase change ink, the thickness of the ink, and movement of the web through the printer can be at a known velocity. Using the known characteristics, the group of offset values can be determined and stored. A second group of offset values can be determined for the same printer but for a different type of media and a different type of ink. By generating a number of different groups of offset values, a particular group of offset values can be used by the printer to adjust the registration of a first side image to a second side image for duplex printing according to media and ink types. In one embodiment, an operator can designate the media type and the ink type through a user interface (not shown) configured to designate ink and media types, and coupled to the controller 128.

Figure 3:
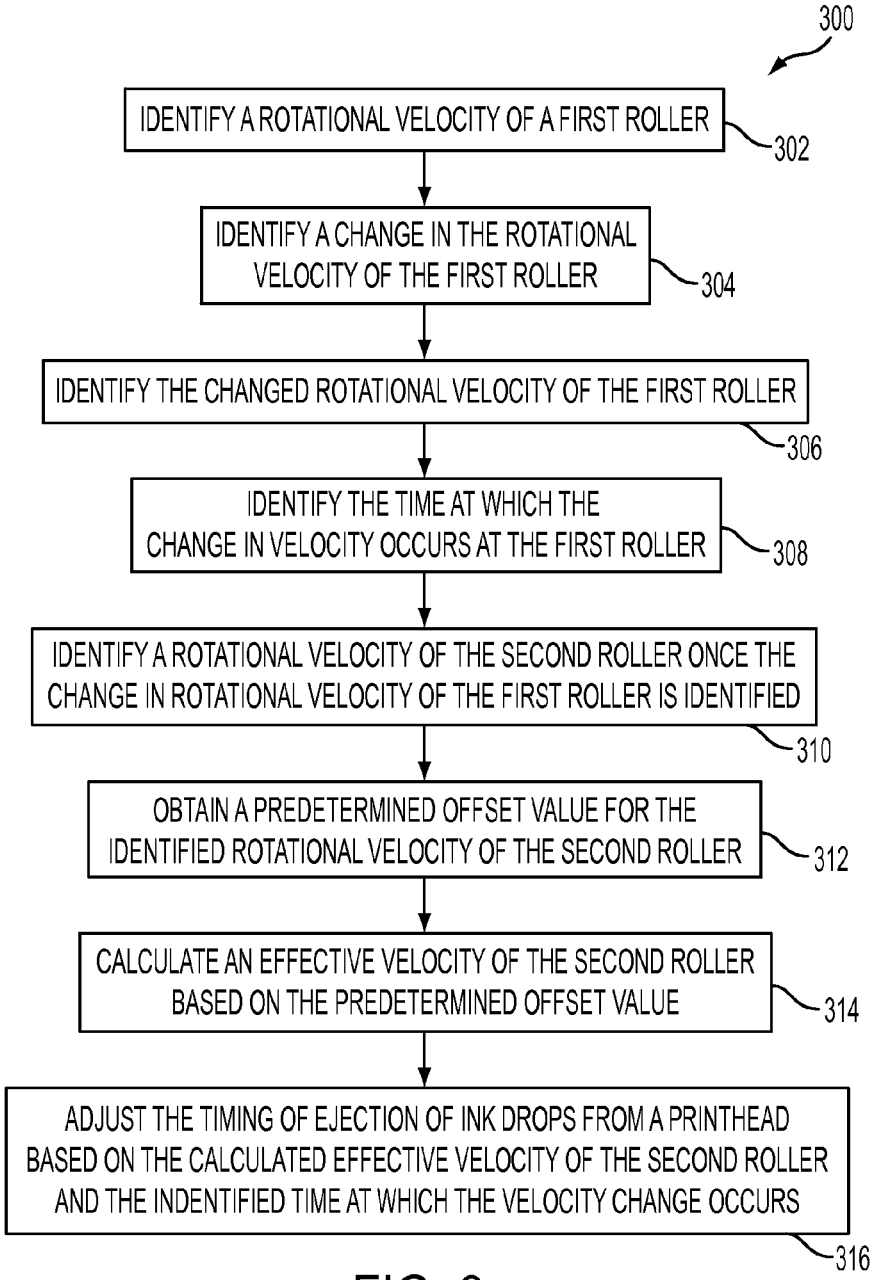
FIG. 3 is a flow diagram of a method of adjusting the timing of the ejection of ink from a printhead on a continuous web of print media based on the location of a leading edge of one side of duplex image.

FIG. 3 illustrates a flow diagram 300 to adjust the timing of ink ejected from the inkjet nozzles. Once the groups of offset values have been determined and stored, the printer 100 can begin a duplex printing operation. After one or more first side images have been deposited on the first side of the web 114 and move through the web inverter 160, adjustment of the registration of a second side image to the first side image can be made, if necessary. The rotational velocity of a first roller, for instance roller 115, is identified (block 302). The rotational velocity is continuously monitored to determine when the velocity of the first roller changes indicating the presence of a first side image on the continuous web (block 304). Once the change in velocity occurs, the changed rotational velocity is identified and stored in the memory 129 (block 306). At substantially the same time that the changed rotational velocity is identified, the time at which the change occurs is also identified (block 308). The identified time of the change is also stored in the memory 129 and is associated with the value of the change in velocity. Once the time of the change in rotational velocity of the first roller is identified, the rotational velocity of the second roller is identified and also stored in the memory 129 (block 310).

Using the determined velocity of the first roller, the changed velocity of the first roller, and the value of the second roller velocity identified after the changed first roller velocity has been determined, a predetermined offset value can be retrieved from the appropriate storage location in the velocity offset lookup table 182 (block 312). Using the retrieved offset value, the effect on the web velocity at the second roller from the line contact of the first side image to the roller 115 can be determined. An effective velocity at the second roller can be calculated based on the predetermined offset value (block 314). This effective velocity can be used in the double reflex printing algorithm along with a time stamp to determine at what time the line contact of the first side image arrives to contact the second roller. Once the effective velocity is determined, the image registration controller 181 can adjust the timing of the ejection of ink from the printhead nozzles as described above (block 316).

As described herein, the presence and thickness of a duplex image and the arrival time at the apex roll can be determined. The integrated average thickness of the first side image is determined by the slowing down of the small diameter backer bar roller 115 with a line contact of ink from the first side image contacting the roller 115 which results in a clear step change in velocity of the continuous web as determined by the low pass filter algorithm. The velocity signal from the backer bar roller 115 is passed through the low pass filter 180 to create a better edge and time stamp for the step change in velocity. The real paper surface velocity is sent to the apex roller with a time stamp to create an offset for the true paper surface speed. The rate change in speed of the apex roller 120 is also a function of duplex image wrap angle on the roll. The time delay can be adjusted when the ink layer arrives at the center of the wrap angle of the apex roll which is half of 114 degrees total wrap or 57 degrees. The adjustment in delay is 15 ms.

It will be appreciated that variants of the above-disclosed and other features and functions, or alternatives thereof, can be desirably combined into many other different systems, applications or methods. While the first roller has been described with reference to the roller 115 and the second roller has been described with reference to roller 120, the rotational velocity of other rollers can be used to determine an offset velocity for adjusting registration of a first side image to a second side image. Various presently unforeseen or unanticipated alternatives, modifications, variations or improvements can be subsequently made by those skilled in the art that are also intended to be encompassed by the following claims.

What is claimed is:

1. A printing system for printing a duplex image having a first side image and a second side image on a continuous web of recording media moving in a downstream direction along a web path from a first roller to a second roller comprising:

a printhead disposed adjacent to the continuous web of recording media, the printhead including a plurality of nozzles configured to eject ink on the recording media;

a first velocity sensor configured to generate a first velocity signal representative of the velocity of the web at the first roller and a second velocity signal representative of a change in velocity of the web at the first roller;

a second velocity sensor configured to generate a second velocity signal representative of the velocity of the web at the second roller;

a controller operatively connected to the printhead, to the first velocity sensor and to the second velocity sensor, the controller being configured to generate a time stamp signal representative of the time of the change in the first velocity signal and to adjust the timing of the ejection of ink based upon the change in the first velocity signal, the second velocity signal, and the time stamp signal.

2. The printing system of claim 1 further comprising a filter operatively connected to the first velocity sensor and to the controller, the filter being configured to pass a frequency component of the first velocity signal below a predetermined value of the first velocity signal.

3. The printing system of claim 2 wherein the controller is further configured to include a comparator operatively connected to the filter, the comparator being configured to determine a step change in the frequency component and to generate the time stamp signal representative of the time at which the step change occurs.

4. The printing system of claim 3 further comprising a memory operatively connected to the controller, the memory being configured to store a plurality of velocity offset values.

5. The printing system of claim 4 wherein the controller is configured to select one of the plurality of velocity offset values based on the change in the first velocity signal and on the second velocity signal to adjust the timing of the ejection of ink.

6. The printing system of claim 5 wherein the change in the first velocity signal corresponds to the first side image contacting the first roller.

7. The printing system of claim 6 wherein the controller is configured to adjust the timing of the ejection of ink to align the second side image with the first side image to print the duplex image.

* * * * *